US008890419B2

(12) United States Patent
Stack

(10) Patent No.: US 8,890,419 B2
(45) **Date of Patent: *Nov. 18, 2014**

(54) SYSTEM AND METHOD PROVIDING LED EMULATION OF INCANDESCENT BULB BRIGHTNESS AND COLOR RESPONSE TO VARYING POWER INPUT AND DIMMER CIRCUIT THEREFOR

(75) Inventor: Thomas E. Stack, Oxford, MI (US)

(73) Assignee: Q Technology, Inc., Livermore, CA (US)

( * ) Notice: Subject to any disclaimer, the term of this patent is extended or adjusted under 35 U.S.C. 154(b) by 416 days.

This patent is subject to a terminal disclaimer.

(21) Appl. No.: 12/906,986

(22) Filed: Oct. 18, 2010

(65) Prior Publication Data

US 2011/0031890 A1 Feb. 10, 2011

Related U.S. Application Data

(63) Continuation-in-part of application No. 12/455,127, filed on May 28, 2009, now Pat. No. 8,354,800.

(60) Provisional application No. 61/279,317, filed on Oct. 19, 2009.

(51) Int. Cl.

| | |
|---|---|
| ***H05B 39/00*** | (2006.01) |
| ***H05B 41/00*** | (2006.01) |
| ***H05B 33/08*** | (2006.01) |

(52) U.S. Cl.

CPC ..... *H05B 33/086* (2013.01); *H05B 33/0809* (2013.01)

USPC ..... 315/185 R; 315/192

(58) Field of Classification Search

USPC ..... 315/185 R, 185 S, 191–192, 200 R, 205, 315/224

See application file for complete search history.

(56) References Cited

U.S. PATENT DOCUMENTS

| | | | | |
|---|---|---|---|---|
| 6,853,150 | B2 * | 2/2005 | Clauberg et al. | 315/185 R |
| 7,221,044 | B2 * | 5/2007 | Fan et al. | 257/676 |
| 7,489,086 | B2 * | 2/2009 | Miskin et al. | 315/185 R |
| 7,847,487 | B2 * | 12/2010 | Kato | 315/192 |
| 7,990,360 | B2 * | 8/2011 | Song et al. | 345/102 |
| 8,072,161 | B2 * | 12/2011 | Yang | 315/307 |
| 8,084,945 | B2 * | 12/2011 | Deppe et al. | 315/32 |
| 2007/0013620 | A1 * | 1/2007 | Tanahashi et al. | 345/82 |
| 2008/0136770 | A1 * | 6/2008 | Peker et al. | 345/102 |
| 2008/0157689 | A1 * | 7/2008 | Kato | 315/185 S |

* cited by examiner

*Primary Examiner* — Minh D A

(74) *Attorney, Agent, or Firm* — Theodore C. Huff

(57) ABSTRACT

A lighting system is disclosed, including a first lighting module and a second lighting module connected parallel to the first lighting module. The first lighting module, with a first activation voltage, generates light at a first color temperature and the second lighting module, with a second activation voltage, generates light at a second color temperature. The two lighting modules generate light when current flows through them. When input voltage is changed, both the amount of current flowing through the two modules changes and the ratio of current flowing through the two lighting modules changes. The change in ratio changes the color temperature of the light produced by the lighting system resulting from combination of the light produced by the two modules. The combined output brightness and color temperature each change with applied power in such a way to emulate the lighting profile of an incandescent lamp.

18 Claims, 10 Drawing Sheets

Fig. 1 (Prior Art, Incandescent Lamp)

Fig. 2 (Prior Art, LED)

SYSTEM AND METHOD PROVIDING LED EMULATION OF INCANDESCENT BULB BRIGHTNESS AND COLOR RESPONSE TO VARYING POWER INPUT AND DIMMER CIRCUIT THEREFOR

CROSS-REFERENCE TO RELATED APPLICATIONS

This patent application is a continuation-in-part of a non-provisional patent application filed May 28, 2009 having application Ser. No. 12/455,127, which has since issued as U.S. Pat. No. 8,354,800 dated Jan. 15, 2013. The entirety of both application Ser. No. 12/455,127 and U.S. Pat. No. 8,354,800 are each incorporated herein by reference. Additionally, this patent application claims the benefit of priority under 35 USC sections 119 and 120 of a provisional patent application filed Oct. 19, 2009 having Application Ser. No. 61/279,317, the entirety which is incorporated herein by reference.

BACKGROUND

This invention relates to LED lighting systems. More particularly, the present invention relates to LED light output color temperature control and dimming.

Incandescent Light, Luminance, and Dimming

For over a century, incandescent lamps reigned supreme as the most used devices to provide light to humanity. When electrical power (measured in Watts, W) is applied to an incandescent lamp, the incandescent lamp produces light.

The total amount of light (luminance) generated by an incandescent lamp depends upon the amount of electrical power applied to the lamp. That is, increases in the input electrical power to an incandescent lamp causes the lamp to produce greater luminance (brighter light) until a threshold is reached where the incandescent lamp fails due to the high input electrical power, duration of time such power is applied to it, or both.

Likewise, decreases in the input electrical power to an incandescent lamp causes the lamp to produce lesser luminance (dimmed light) until the input electrical power is decreased to a threshold value below which no light is produced by the lamp. Luminance is a photometric measure of the luminous intensity per unit area of light travelling in a given direction. The international system of units (SI) unit for luminance is candela per square meter (cd/m$^2$). In the drawings and in this document, luminance is represented by capital letter L.

FIG. 1 is a diagram illustrating, inter alia, relationship between the input power levels (the X-axis) and corresponding output luminance (the first Y-axis) of an incandescent lamp. As illustrated by luminance curve 10 (sold line curve), at a first threshold input power, $W_{TH1}$, the incandescent lamp begins to produce light at some minimal luminance, $L_{MIN1}$. The luminance 10 increases as the input power increases until at a second threshold input power, $W_{TH2}$, the lamp produces light at its maximum luminance, $L_{MAX1}$. Further increases in the input power beyond the second threshold level, $W_{TH2}$, would cause the incandescent lamp to fail prematurely and this is not illustrated in the Figures. The luminance curve 10 is a generalized and simplified representation of the relationship between the input power and the output luminance of an incandescent lamp; the curve 10 is used for illustrative purposes only and as an aid to understanding the relationship. For example, the luminance curve 10, as illustrated, may appear to indicate a mostly linear relationship between the input power and the output brightness. However, typically the relationship is closer to logarithmic. Here, the Output Brightness scale (the first Y-axis) may be in logarithmic scale. In any scale, the discussed relationship of increasing power leading to increased luminance output is valid.

Accordingly, the amount of light produced by an incandescent lamp can be controlled by a dimming switch. The dimming switch controls the input power to the incandescent lamp, which, in turn, controls the luminance of the produced light. This dimming effect is useful for many applications including, for example only, ambient mood lighting.

In addition to the dimming effect, changes in the input power level (to the incandescent lamp) change the color temperature of the produced light.

Color Temperature

Color temperature is a characteristic of light that may be defined and understood in a number of different ways. Light is electro-magnetic radiation at a range of frequencies. The perceived color of light depends on the frequency (or wavelength) of the radiation. Most light, especially ambient light such as the light produced by incandescent lamp is a mixture of, or combination of, light have at a range of frequencies (or, differently expressed, at different wavelengths, or "colors").

Color temperature of light can be understood as the spectral distribution and content of the light. More simply, color temperature is the relative amounts of different "colors" present in the light. Color temperature is measured using a scale having Kelvin (K) units.

For example, a burning candle typically generates light having a wide spectrum of colors; however, in the candle light, the dominant light components have yellow and orange color. Accordingly, overall, candle light is typically characterized as having a color temperature below 1,900 degrees Kelvin. An incandescent lamp typically generates light having a wide spectrum of colors; however, here, overall, incandescent light is typically characterized as having color temperature ranging approximately from 2,500 to 3,500 degrees Kelvin. These two examples are of comparatively low color temperature light having comparatively more yellow to red light components. Such light is generally referred to as being "warm" or "soft" light.

Higher color temperature light has comparatively more white to blue components and is generally referred to as being "cold" or "harsh" light. For example, "white" fluorescent lighting often found at retail spaces and offices is characterized as having color temperature ranging approximately from 3,500 to 4,500 degrees Kelvin. The sunlight at mid summer day has color temperature ranging approximately from 5,500 to 6,000 degrees Kelvin.

Color Temperature Changes During Dimming of Incandescent Lamps

Changes in the input power level to an incandescent lamp not only change the output luminance, but also change the color temperature of the light produced by the incandescent lamp.

FIG. 1 also illustrates relationship between the input power levels (the X-axis) and the color temperature (the second Y-axis) of the light produced by an incandescent lamp at various power levels. As illustrated by color temperature curve 12 (dashed line curve), at relatively higher power levels (and correspondingly higher luminance), the produced light has a comparatively higher color temperature indicated in FIG. 1 as temperature $K_{HIGH}$. Also illustrated by the color temperature curve 12, as the input power level is decreased (and the luminance reduces as illustrated by curve 10) the color temperature of the produced light also decreases toward a lower color temperature indicated in FIG. 1 as temperature $K_{LOW}$. That is, the incandescent light has a color temperature range 14 as illustrated. In some applications, lower color temperature light is preferred because the lower color temperature light may be perceived as a warmer, softer light.

For residential ambient lighting applications, the low and the high color temperature values $K_{LOW}$ and $K_{HIGH}$ may range approximately 2,500 to 3,500 degrees Kelvin, respectively. However, the actual values of the color temperature may vary widely outside of these values depending on many factors. The color temperature curve 12 is a generalized and simplified representation of the relationship between the input power and the color temperature of the produced light of an incandescent lamp; the curve 12 is used for illustrative purposes only and as an aid to understanding the relationship.

Incandescent Dimming Effect in Both Luminance and Color Temperature

As discussed above, for incandescent lamps, when input power is dimmed, both the output luminance and the color temperature of the output light are reduced. The result of the dimming is softer, warmer, and more pleasing light. For many lighting applications, this is a desirable characteristic of incandescent lamps.

Incandescent Dimming Effect in Both Luminance and Color Temperature

Even with such desirable operating characteristics, the use of incandescent lamps is being discouraged. In its place, light emitting diodes (LEDs) are being used to provide lighting in many applications. LEDs are much more energy efficient compared to the energy efficiencies of incandescent lamps.

Similar to the incandescent lamps, the luminance of the light produced by LEDs can be varied by varying the input power to the LEDs. However, variations in the input power to the LEDs do not lead to any significant changes of the color temperature of the light produced by an LED. In "white" LEDs that have a blue semiconductor and yellow phosphor, there may reach a point on overdriving the LED that the phosphor would be saturated and only blue light would increase upon further energy input. This would not be good for the longevity of the LED, however. Additionally, there may be a thermal effect that at higher temperatures the spectrum changes slightly, but again this is not good for the LED lifetime.

FIG. 2 is a diagram illustrating, inter alia, relationship between the input power levels (the X-axis) and corresponding output luminance (the first Y-axis) of an LED. As illustrated by luminance curve 20 (sold line curve), at a third threshold input power, $W_{TH3}$, the LED begins to produce light at some minimal luminance, $L_{MIN2}$. The luminance 20 increases as the input power increases until at a fourth threshold input power, $W_{TH4}$, the LED produces light at its maximum rated luminance, $L_{MAX2}$. The luminance curve 20 is a generalized and simplified representation of the relationship between the input power and the output luminance of an LED; the curve 20 is used for illustrative purposes only and as an aid to understanding the relationship. Accordingly, the amount of light produced by an incandescent lamp can be controlled by a dimming switch. However, changes in the input power level do not result in significant change in the color temperature of the light produced. This is illustrated by color temperature curve 22 (dashed line). Increased input power may cause slight changes in the color temperature of the light from an LED. This may be due to phosphor saturation, thermal changes, or both causing change in the color temperature. This is illustrated as a color temperature range 24. In the Figure, the range 24 is illustrated in exaggerated matter to more clearly indicate the slight range. This color temperature range is not significant and is typically not even perceptible for standard operating range for ambient temperature. In fact, the color temperature range 24 is orders of magnitude lower than the color temperature range 14 (of FIG. 1). Applied power beyond $W_{TH4}$ is not recommended for the longevity of the device. In the range above $W_{TH4}$, though there may be phosphor saturation or thermal effects affecting the color temperature, again, this is at the risk of shortening LED life.

That is, dimming of (reducing the input power to) an LED lamp over its recommended operating range results in a dimmer light but not softer or warmer light. In this way, the LED lamp lacks a desired operating characteristic compared to the incandescent lamp. In addition, LEDs present a nonlinear current load to applied electrical voltage, especially when alternating current (AC) power is applied. This may create a high total harmonic distortion (THD). This is an undesirable characteristic of LED lamps.

Accordingly, the need remains for LED based lighting systems having color temperature properties similar to incandescent lighting while maintaining low THD values and high efficiency.

SUMMARY OF THE INVENTION

The need is met by the apparatus and methods of the present invention. In a first embodiment of the present invention, a lighting system includes a first lighting module and a second lighting module. The first lighting module includes at least one light emitting element, the light emitting element of the first lighting module generating, when power is applied, light at a first color temperature. The second lighting module includes at least one light emitting element, the light emitting element of the second lighting module generating, when power is applied, light at a second color temperature. The first lighting module activates at a first activation voltage. The second lighting module activates at a second activation voltage. The lighting elements of these lighting modules can be light emitting diodes (LEDs) or any other electrically activated lighting device.

In one embodiment of the present invention, a lighting system includes a first lighting module and a second lighting module. The first lighting module includes at least one light emitting element, the light emitting element of the first lighting module generating, when power is applied, light at a first color temperature. The second lighting module includes at least one light emitting element, the light emitting element of the second lighting module generating, when power is applied, light at a second color temperature. The first lighting module activates at a first activation voltage. The second lighting module activates at a second activation voltage. The lighting elements of these lighting modules can be light emitting diodes (LEDs) or any other electrically activated lighting device. A first capacitor is connected in series with the first lighting module, the first capacitor connected in parallel to said second lighting module. A second capacitor is connected in series with both said first lighting module and the second lighting module. The second lighting module is electrically connected in parallel to the first lighting module. When electrical power is applied to the lighting system, the first lighting module conducts electrical current during a first conduction period within each power cycle and the second lighting module conducts electrical current during a second conduction period within each power cycle.

In a third embodiment of the present invention, a method of generating light is disclosed. At application of electrical energy, a first lighting module is activated at a first activation voltage and a second lighting module is activated at a second activation voltage. The first lighting module includes at least one light emitting element, which when activated, generates light at a first range of color temperature. The second lighting module includes at least one light emitting element, which when activated, generates light at a second range of color temperature.

DETAILED DESCRIPTION

In the present invention, a lighting system includes a first lighting module including at least one light emitting element, and a second lighting module including at least one light emitting element. The lighting elements may be, for example, LEDs. The second lighting module is electrically connected in parallel to the first lighting module. The first lighting module has a first activation voltage. When activated, the first lighting module generates light at a first color temperature. The second lighting module has a second activation voltage. When activated, the second lighting module generates light at a second color temperature.

Because the lighting modules have different activation voltages, they are activated for different durations during each power cycle. Furthermore, because the lighting modules generate light at different color temperatures, the color temperature of light generated by the combined light from these two modules is a third color temperature (combined light color temperature).

Utilizing these factors, by adjusting the amount of light generated by each of the two lighting modules, the color temperature of the combined light can be changed. Finally, the amount of light generated by each of the two lighting modules can be varied by adjusting the input voltage.

That is, by varying (increasing or decreasing ("dimming")) the input voltage, the ratio of light generated by each of the lighting modules can be changed. Because each of the lighting modules generates light having different color temperature (compared to the color temperature of the other lighting module), when the ratio changes, the color temperature of the resulting combined light changes, and the desired effect is achieved. This is illustrated in the Figures and discussed in more detail below.

In the Figures, various graphs and curves are generalized and simplified representation of the relationship between various electrical voltages, currents, and responses used for illustrative purposes only and as an aid to the disclosure and for even better understanding of the present invention.

First Embodiment

Figure 1:
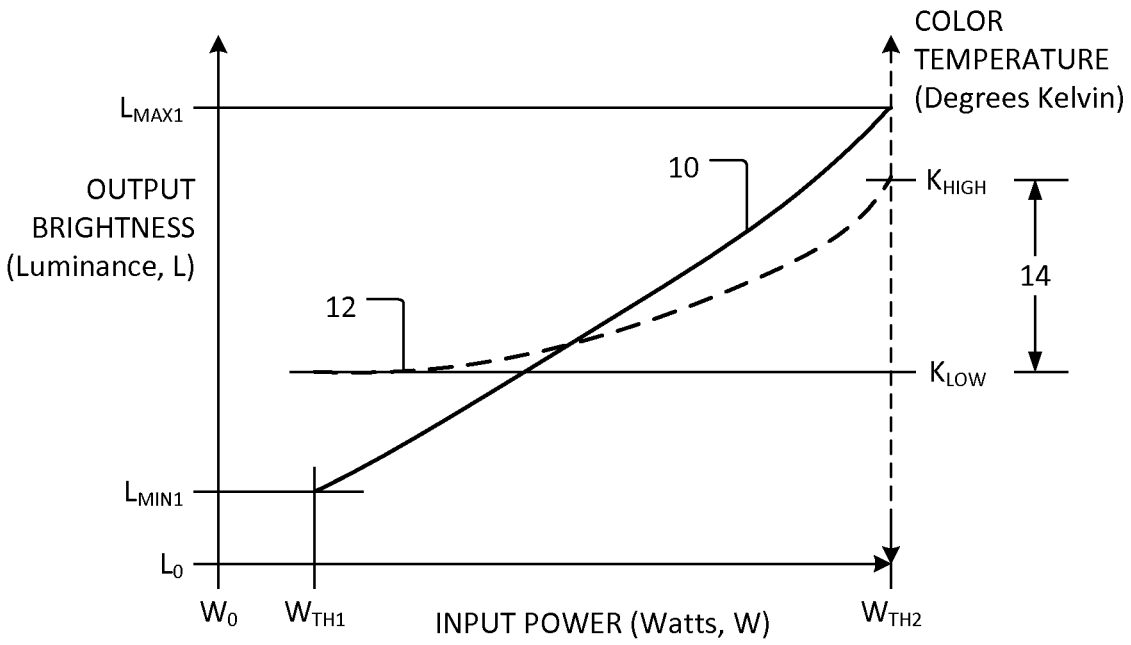
FIG. 1 is a graph illustrating various characteristics of a prior art incandescent lamp.
Figure 2:
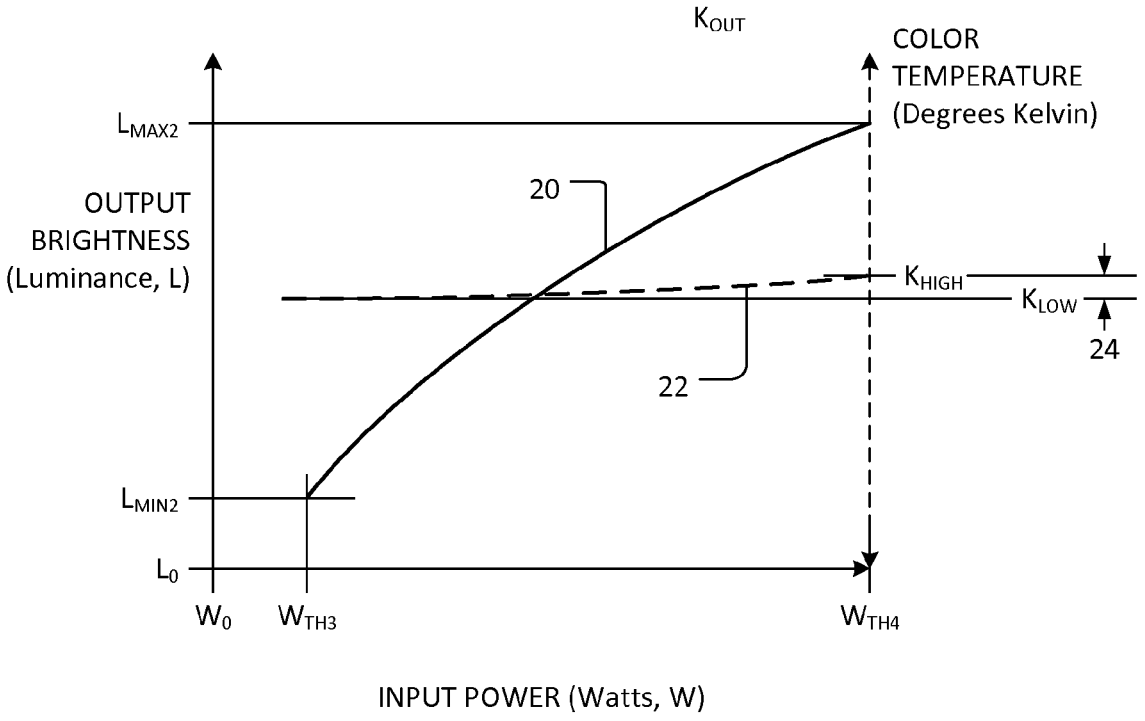
FIG. 2 is a graph illustrating various characteristics of a prior art LED lamp.
Figure 3:
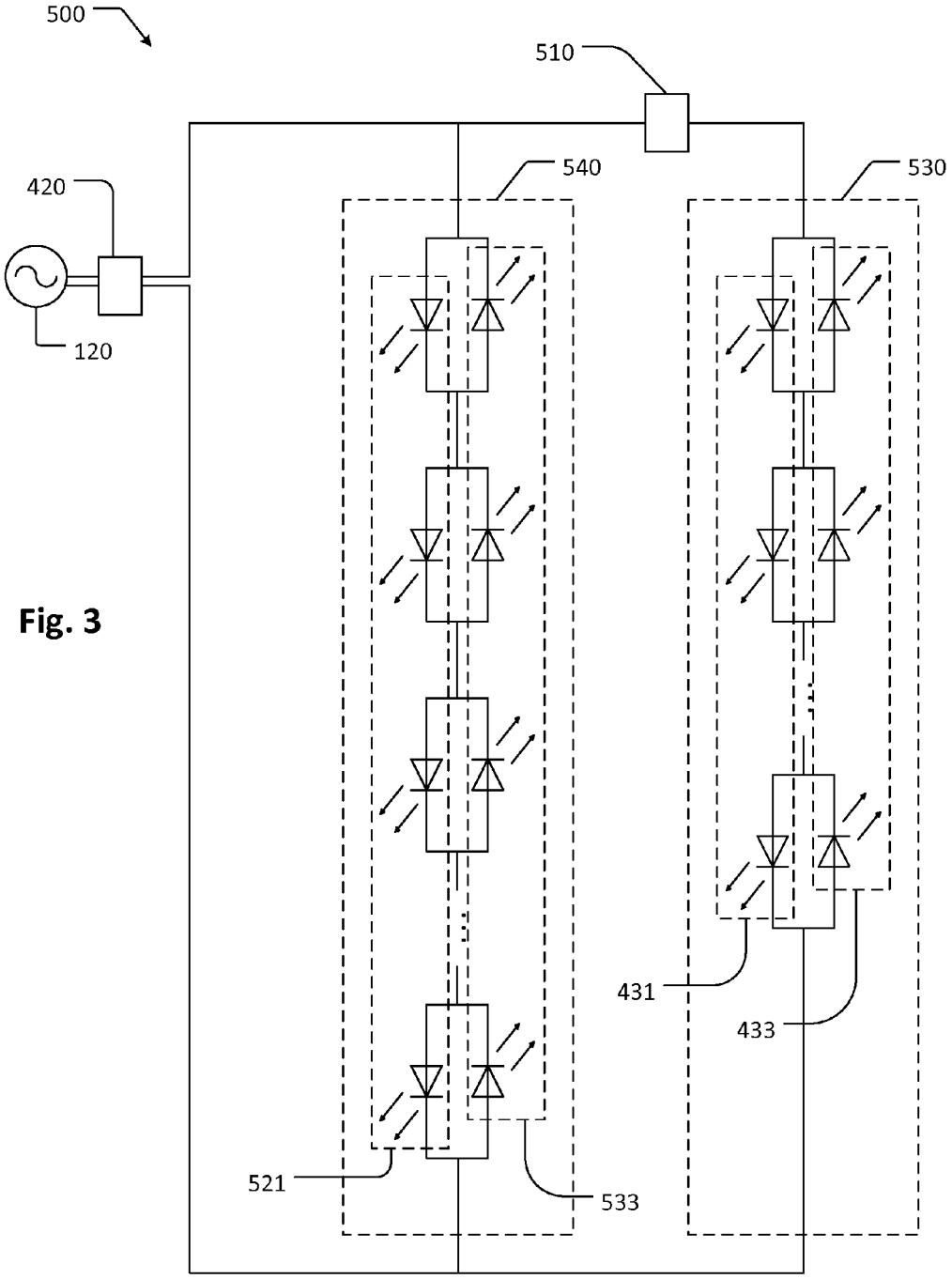
FIG. 3 is a lighting system in accordance with one embodiment of the present invention.

FIG. 3 illustrates a lighting system 500 in accordance with one embodiment of the present invention. Referring to FIG. 3, the lighting system 500 includes a first lighting module 530 and a second lighting module 540. The first lighting module 530 is adapted to connect to an alternating current (AC) electrical power source 120 via a dimming device 420. In the U.S., the AC power 120 provides a cyclical voltage of approximately 120 volts RMS (root mean square) with a peak voltage value ranging from approximately positive 170 volts (V) to approximately negative 170 volts. In Europe and other countries, the available AC power is approximately 240 volts RMS. Other countries may use a different frequency, for example, 50 Hz. Other platforms (for example, aircraft avionics) may use another frequency such as 400 Hz. The same principles apply to the following discussion regardless of applied oscillatory voltage or frequency. There are a number of dimmers in the marketplace that can be used for the dimming device 420.

Although the AC electrical power source 120 provides the power to drive the lighting system 500, the lighting system 500 is not directly connected to the power source 120. Rather, the lighting system 500 is directly connected to the dimming device 420 and operates on the electrical power that the dimming device 420 allows through to the lighting system 500. In fact, often, dimming devices include switches that open the circuit thus separating the power source 120 from the lighting system 500. For this reason, in this document, "electrical power", "input power" and similar terms and phrases indicate the power applied to the lighting systems of the present invention from the dimming device 420.

The dimming device 420 provides alternating current (AC) electrical power, the electrical power having power cycles. In the U.S., the AC power provides a cyclical voltage of approximately 120 volts RMS (root mean square) with a peak voltage value ranging from approximately positive 170 volts to approximately negative 170 volts. In Europe and other countries, the available AC power is approximately 220 volts RMS. The first lighting module 530 defines a first current path and the second lighting module 540 defines a second current path. Further, the dimming device 420 provides electrical power at different voltages. Often, that is the function of the dimming device 420. There are many prior art devices and techniques for providing variable power source to the lighting system 500.

Figure 4:
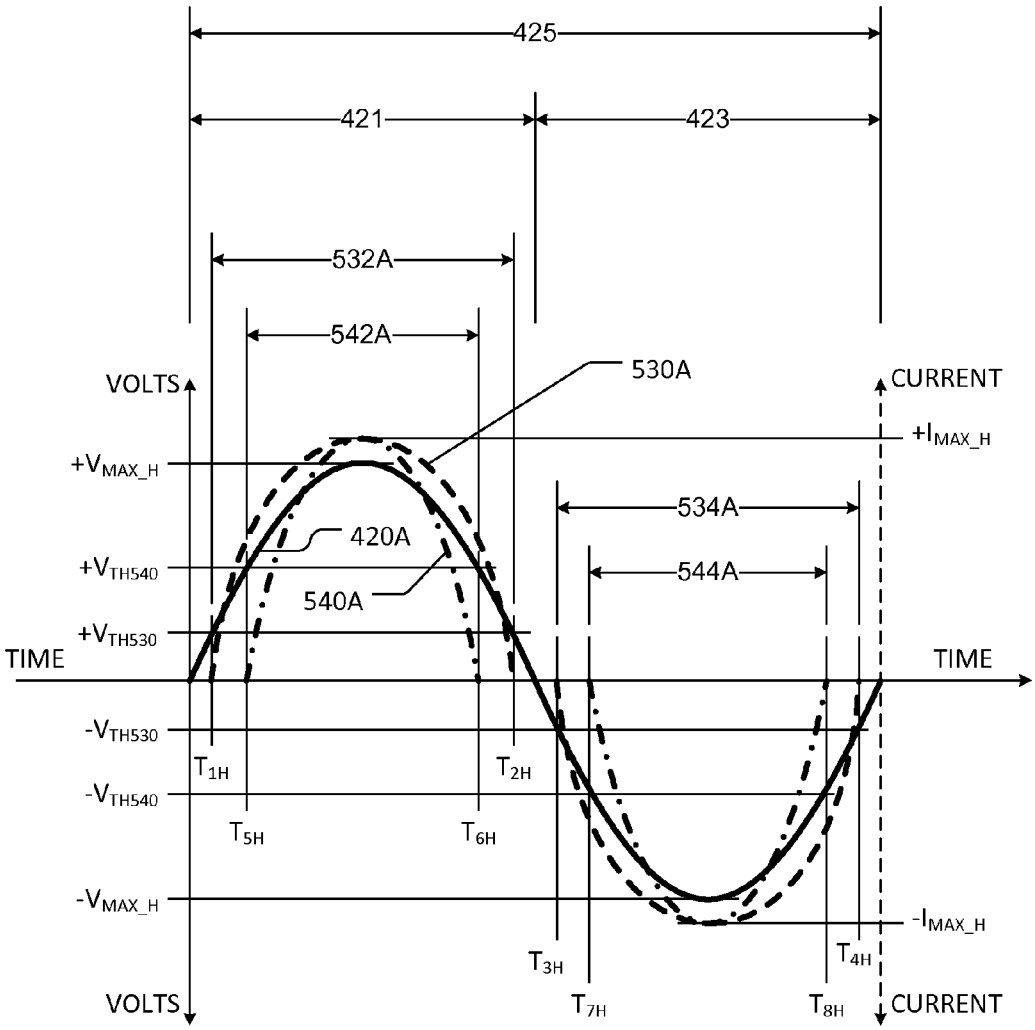
FIGS. 4 and 5 are graphs illustrating various electrical characteristics of the embodiment of FIG. 3.
Figure 5:
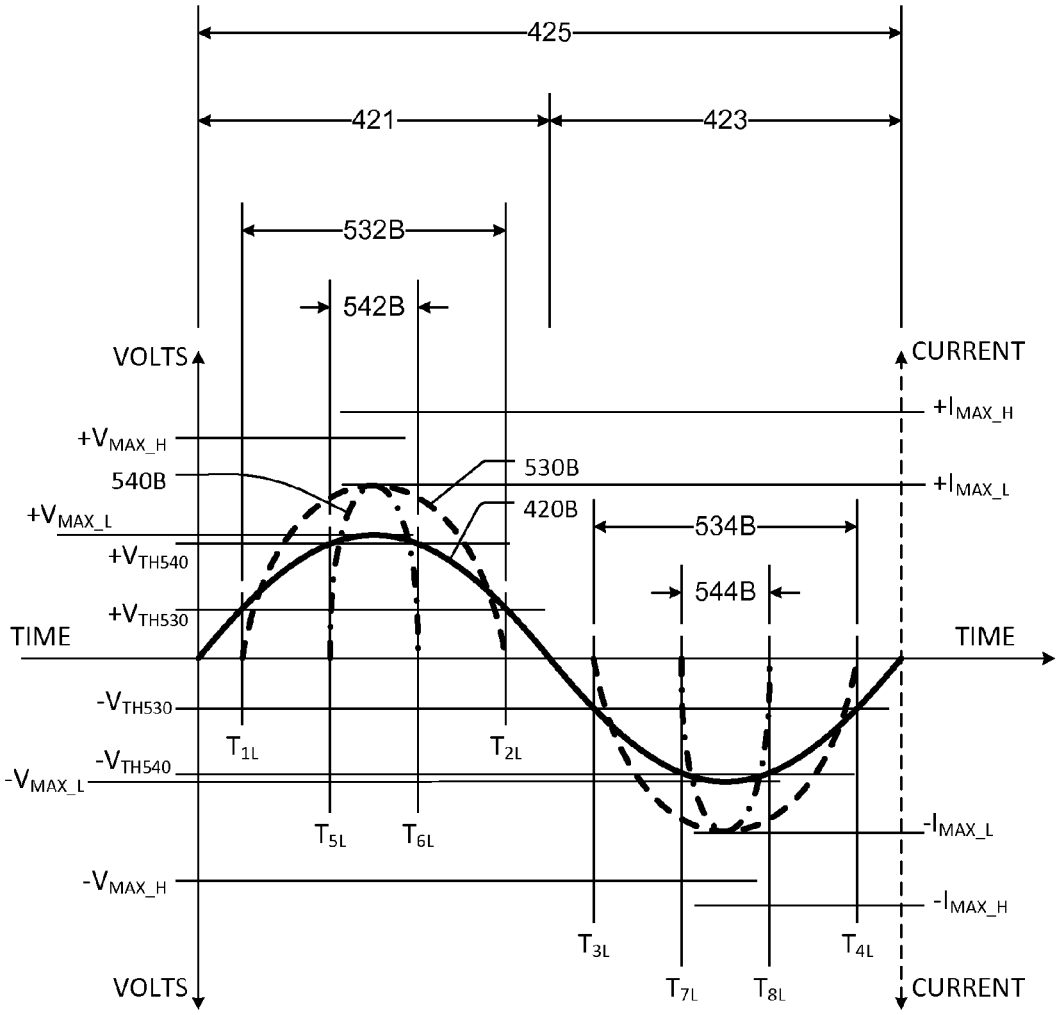

FIGS. 4 and 5 are graphs illustrating various electrical characteristics of the embodiment of FIG. 3. In the graphs of FIGS. 4 and 5, the X-axis represents time flowing from left to right; the first Y-axis (solid line) represents electrical voltage applied to the lighting system 500; and the second Y-axis (dashed line) represents current flowing in the lighting system 500.

Referring to FIGS. 3, 4, and 5, the input AC power from the dimming device 420 is cyclical in that the AC power typically has an oscillation frequency of approximately 60 Hertz (Hz). FIGS. 4 and 5 illustrate a single oscillation of the input AC power voltage as represented by solid line graphs 420A and 420B where graph line 420A is the input AC power at some higher voltage swing (compared to the voltage swing of 420B) and, correspondingly, 420B at some lower voltage swing (compared to the voltage swing of 420A). Each complete oscillation of voltages is considered a complete power cycle and includes 360 degrees.

As illustrated, a single power cycle, in this example, lasts approximately 16.7 milliseconds (ms) which is one second divided by 60 cycles. For convenience of discussion herein, a single power cycle period 425 is used to discuss the operations of the lighting system 500. As for the beginning and the ending of the power cycle period 425, it is arbitrary where the power cycle is deemed to begin and to end as long as the power cycle period 425 includes a complete oscillation, the entire 360 degrees. The single power cycle 425 can be divided into a positive swing cycle 421 and the negative swing cycle 423.

The first lighting module 530 includes at least one light emitting element, for example, an LED. The LED of the first lighting module 530 generates, when sufficient electrical power is applied, light at a first color temperature. This can be any color temperature depending on the desired application. For ambient lighting, the LEDs of the first lighting module 530 generates light having color temperature of about 3,500 degrees Kelvin.

Further, the first lighting module 530 has a first activation voltage. That is, the first lighting module 530 has a threshold voltage, $V_{TH530}$, necessary for the LEDs of the first lighting module 530 to conduct electricity and to generate light. Some LEDs have a turn-on voltage of about 2.5 volts. The first activation voltage can be achieved using various techniques including, for example only, serially connecting a number of LEDs, and optionally connecting resistor elements.

In the illustrated example embodiment, the first lighting module 530 includes a plurality of pairs of LEDs, and each pair including a first lighting element connected in a first electrical direction and a second lighting element connected in a second electrical direction, the second electrical direction opposite the first electrical direction.

The second lighting module 540 includes at least one light emitting element, for example, an LED. The LED of the second lighting module 540 generates, when sufficient electrical power is applied, light at a second color temperature. This can be any color temperature depending on the desired application. For ambient lighting, the LEDs of the second lighting module 540 generates light having color temperature of about 4,100 degrees Kelvin. Further, the second lighting module 540 has a second activation voltage. That is, the second lighting module 540 has a threshold voltage, $V_{TH540}$, necessary for the LEDs of the second lighting module 540 to conduct electricity and to generate light. The second activation voltage can be achieved using various techniques including, for example only, serially connecting a number of LEDs, along with optionally connecting resistor elements. The second lighting module 540 is electrically connected in parallel with respect to the first lighting module 530. In the present example, the first activation voltage $V_{TH530}$ is lower than the second activation voltage $V_{TH540}$.

In the illustrated example embodiment, the second lighting module 540 includes a plurality of pairs of LEDs, each pair including a first lighting element connected in a first electrical direction and a second lighting element connected in a second electrical direction, the second electrical direction opposite the first electrical direction.

The actual numbers of LEDs for the lighting modules 530 and 540 are implementation dependent and can vary widely. The lighting modules 530 and 540 may have the same number of LEDs or different number of LEDs. In the present example embodiment, the first lighting module 530 includes a first predetermined number of LEDs, for example 12 LED pairs (for a total of 24 LEDs), and the second lighting module 540 includes a second predetermined number of LEDs, for example 21 LED pairs (for a total of 42 LEDs), wherein the first predetermined number is less than the second predetermined number.

Operation of the Lighting System 500 with a Comparative High Input Voltage

Referring to FIGS. 3 and 4, when a comparatively high input voltage power 420A is applied to the system 500, during its positive swing cycle 421, the forward biased LED grouping 431 of the first lighting module 530 conducts current (and generates light) when its activation threshold voltage $V_{TH530}$ is exceeded at time $T_{1H}$. The first lighting module current is represented by dashed curve 530A. The first lighting module 530 continues to conduct current (and generate light) 530A until the applied voltage 420A fails to exceed its activation threshold voltage $V_{TH530}$ at time $T_{2H}$. In the Figures, this period of time is indicated as duration 532A.

Additionally, in response to the comparatively high voltage of the positive swing cycle 421 of the input power 420A, the forward biased LED grouping 521 of the second lighting module 540 conducts current (and generates light) when its activation threshold voltage $V_{TH540}$ is exceeded at time $T_{5H}$. The second lighting module current is represented by dash-dot curve 540A. The second lighting module 540 continues to conduct current (and generate light) 540A until the applied voltage 420A fails to exceed its activation threshold voltage $V_{TH540}$ at time $T_{6H}$. In the Figures, this period of time is indicated as duration 542A.

A current limiting element 510 is connected in series with the first lighting module 530 but in parallel with the second lighting module 540. The current limiting element 510, in combination with the first lighting module 530, provides for sufficient resistance, reactance, or both, at time $T_{5H}$, to allow the voltage $V_{TH540}$ to be applied across the second lighting module 540. Depending on the application, the current limiting element 510 may be implemented using a resistor, capacitor, inductor, transistor, diode, or any combination of these electrical components.

Note that the duration 542A is slightly less than the duration 532A. This is because the second activation voltage $V_{TH540}$ is higher than the first activation voltage $V_{TH530}$ and that the high voltage input AC power 420A takes slightly longer to reach and exceed the higher activation voltage $V_{TH540}$ than it takes to reach the first activation voltage $V_{TH530}$.

Similarly, during the negative swing cycle 423 of the applied voltage 420A, the reverse biased LED grouping 433 of the first lighting module 530 conducts current (and generates light) when its activation threshold voltage $V_{TH530}$ is exceeded at time $T_{3H}$. The first lighting module 530 continues to conduct current (and generate light) until the applied voltage 420A fails to exceed its activation threshold voltage $V_{TH530}$ at time $T_{4H}$. In the Figures, this period of time is indicated as duration 534A.

Additionally, in response to the comparatively high voltage of the negative swing cycle 423 of the input power 420A, the reverse biased LED grouping 533 of the second lighting module 540 conducts current (and generates light) when its activation threshold voltage $V_{TH540}$ is exceeded at time $T_{7H}$. The second lighting module 540 continues to conduct current (and generate light) until the applied voltage 420A fails to exceed its activation threshold voltage $V_{TH540}$ at time $T_{8H}$. In the Figures, this period of time is indicated as duration 544A.

Operation of the Lighting System 500 with a Comparative Low Input Voltage

Referring to FIGS. 3 and 5, when a comparatively low voltage power 420B is applied to the system 500, during its positive swing cycle 421, the forward biased LED grouping 431 of the first lighting module 530 conducts current (and generates light) when its activation threshold voltage $V_{TH530}$ is exceeded at time $T_{1L}$. Here, the first lighting module current is represented by dashed curve 530B. The first lighting module 530 continues to conduct current (and generate light) 530B until the applied voltage 420B fails to exceed its activation threshold voltage $V_{TH530}$ at time $T_{2L}$. In the Figures, this period of time is indicated as duration 532B.

Additionally, in response to the comparatively high voltage of the positive swing cycle 421 of the input power 420B, the forward biased LED grouping 531 of the second lighting module 540 conducts current (and generates light) when its activation threshold voltage $V_{TH540}$ is exceeded at time $T_{5L}$. Here, the second lighting module current is represented by dash-dot curve 540B. The second lighting module 540 continues to conduct current (and generate light) 540B until the applied voltage 420B fails to exceed its activation threshold voltage $V_{TH540}$ at time $T_{6L}$. In the Figures, this period of time is indicated as duration 546.

Note that the duration 542B is significantly less than the duration 532B. This is because the activation voltage $V_{TH540}$ is higher than the first activation voltage $V_{TH530}$ and that the lower voltage input AC power 420B takes significantly longer to reach and exceed the second activation voltage $V_{TH540}$ than it takes to reach the first activation voltage $V_{TH530}$.

Similarly, during the negative swing cycle 423 of the applied voltage 420B, the reverse biased LED grouping 433 of the first lighting module 530 conducts current (and generates light) when its activation threshold voltage $V_{TH530}$ is exceeded at time $T_{3L}$. The first lighting module 530 continues to conduct current (and generate light) until the applied voltage 420B fails to exceed its activation threshold voltage $V_{TH530}$ at time $T_{4L}$. In the Figures, this period of time is indicated as duration 534B.

Additionally, in response to the comparatively high voltage of the negative swing cycle 423 of the input power 420B, the reverse biased LED grouping 533 of the second lighting module 540 conducts current (and generates light) when its activation threshold voltage $V_{TH540}$ is exceeded at time $T_{7L}$. The second lighting module 540 continues to conduct current (and generate light) until the applied voltage 420B fails to exceed its activation threshold voltage $V_{TH540}$ at time $T_{8L}$. In the Figures, this period of time is indicated as duration 544B.

Luminance of the Lighting System 500 at Differing Input Voltages

Referring to FIGS. 3, 4, and 5, during the illustrated complete cycle of the high input voltage 420A, the input voltage may swing between maximum value of $+V_{MAX_H}$ and $-V_{MAX_H}$. The current in the lighting modules may reach a maximum value of $+I_{MAX_H}$ and $-I_{MAX_H}$. Actual numbers for these values depend on the implementation. In one example, using the common AC power available in the U.S., the $V_{MAX_H}$ may swing between +170 volts and −170 Volts.

In contrast, with the low input voltage 420B, the input voltage may swing between maximum value of $+V_{MAX_L}$ and $-V_{MAX_L}$. The current in the lighting modules may reach a maximum value of $+I_{MAX_L}$ and $-I_{MAX_L}$. Actual numbers for these values depend on the implementation. In one example, using the common AC power available in the U.S., the $V_{MAX_L}$ may swing voltages less than +170 and −170 Volts.

The exact numerical value and the exact shape of these curves are implementation dependent; however, the maximum positive and negative currents, $+I_{MAX_H}$ and $-I_{MAX_H}$ may range between plus and minus 670 mA (peak of the AC waveform). As for $+I_{MAX_L}$ and $-I_{MAX_L}$ these values would be less than $+I_{MAX_H}$ and $-I_{MAX_H}$ values.

Note that with the higher input voltage 420A, the more current 530A and 540A flows through the two modules compared to the current 530B and 540B flowing through the two modules in response to the lower input voltage 420B. That is, as illustrated by the graphs, electrical currents 530A and 540A have greater positive and negative values compared to the values of electrical currents 530B and 540B. Moreover, currents 530A and 540A flow for greater periods of time (532A and 542A, respectively) compared to the periods of time (532B and 542B) than currents 530B and 540B. This means that, with the higher input voltage 420A, the lighting system 500 generates more light (greater luminance), and that with the lower input voltage 420B, the lighting system 500 generates less light, lower luminance. This is a desired response.

Color Temperature of Light Generated by the Lighting System 500 at Differing Input Voltages As already discussed above, generally, LED lighting elements generate light having the same color temperature independent of the input voltage level. While the lighting system 500 utilize these LED lighting elements, the lighting system 500 of the present invention allows for changes in the color temperature of the light in response to changes in the input voltage level by using two lighting modules, each lighting module generating light having different color temperature.

In the present example, the first lighting module 530 generates light having color temperature of about 3,500 degrees Kelvin, and the second lighting module 540 generates light having color temperature of about 4,100 degrees Kelvin. Combined, light from these two modules would result in light having color temperature between these two values. If the two lighting modules were generating the same luminance relative to each other, then the combined light color temperature would have been 3,800 degrees Kelvin, the average of 3,500 and 4,100.

Continuing to refer to FIGS. 3, 4, and 5, when the higher input voltage 420A is applied, the duration 542A in which the second lighting module conducts current (generates light) is only slightly less than the duration 532A in which the first lighting module conducts current (generates light). That is, the ratio between the luminance of the second lighting module 540 to the luminance of the first lighting module 530 is close to one (1). Since the second lighting module contributes slightly less luminance (compared to the luminance of the light generated by the first lighting module), the combined light color temperature is likely to be slightly below 3,800 degree Kelvin and can be, for example only, 3,750 degrees Kelvin.

When the lower input voltage 420B is applied, the duration 542B in which the second lighting module conducts current (generates light) is significantly less than the duration 532B in which the first lighting module conducts current (generates light). That is, the ratio between the luminance of the second lighting module 540 to the luminance of the first lighting module 530 is significantly less than one. Since the second lighting module contributes significantly less luminance (compared to the luminance of the light generated by the first lighting module 530), the combined light color temperature is likely to be significantly below the average of 3,800 degree Kelvin and can be, for example only, 3,600 degrees Kelvin.

This means that, with the higher input voltage 420A, the lighting system 500 generates light having higher color temperatures, and that with the lower input voltage 420B, the lighting system 500 generates having a lower color temperature (softer, warmer light). This is a desired response.

Second Embodiment

The lighting system 500 of FIG. 3 may suffer from some level of undesired harmonic distortions because total current drawn by the system 500 from its input power source 420 may not represent a linear response to the sinusoidal shape of the input power. Total harmonic distortions (THD) and the techniques of reducing THD are disclosed in more detail in U.S.

application Ser. No. 12/455,127, which has since issued as U.S. Pat. No. 8,354,800, the entirety of which both are incorporated herein by reference.

Figure 6:
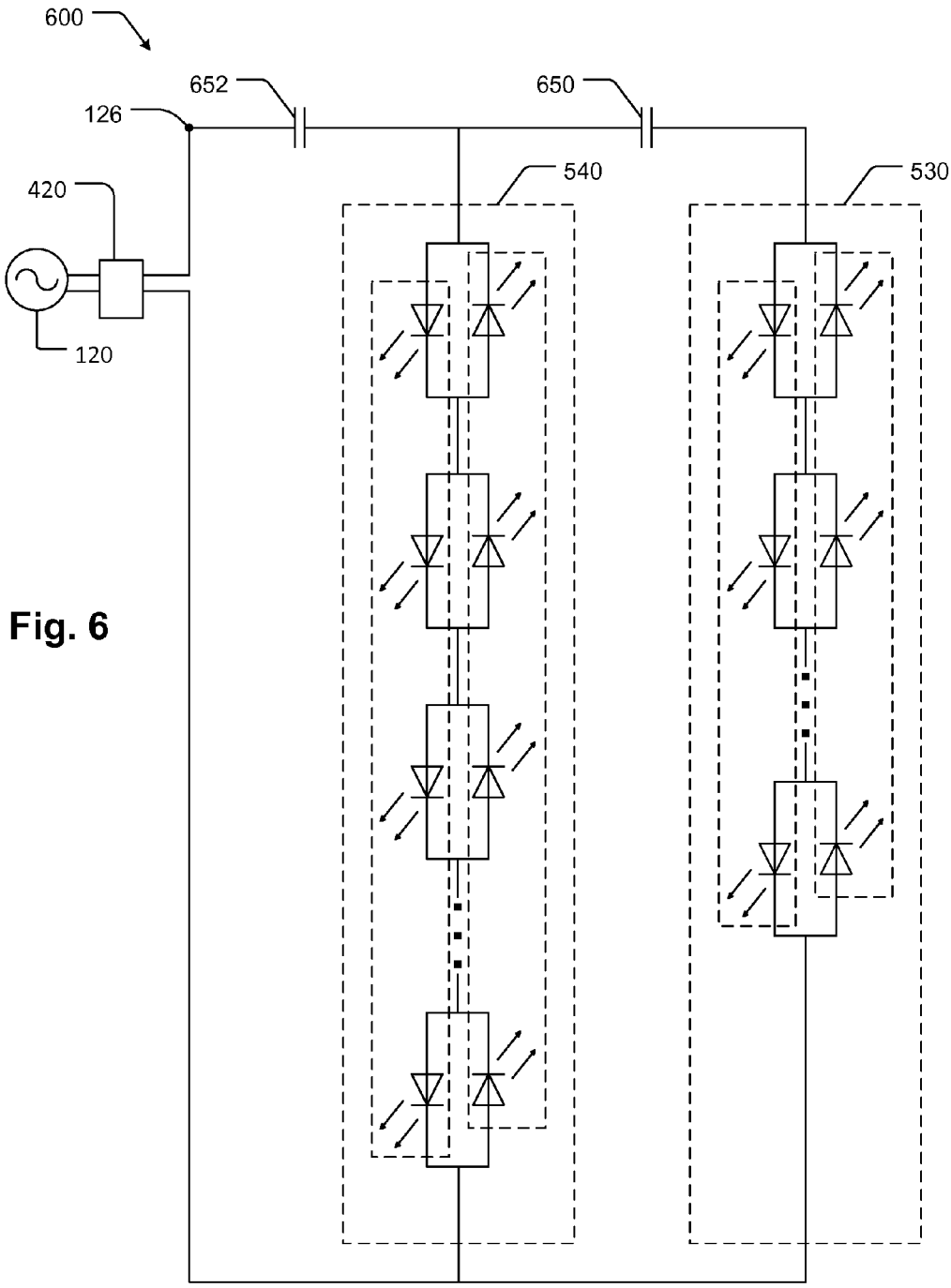
FIG. 6 is a lighting system in accordance with another embodiment of the present invention.

FIG. 6 illustrates a lighting system 600 in accordance with another embodiment of the present invention. Referring to FIG. 6, the lighting system 600 includes a first lighting module 530 and a second lighting module 540. The lighting modules 530 and 540 are configured similarly to those of FIG. 3 and discussed above. Other portions of the lighting system 600 that are similar to the lighting system 500 include the variable input power source 420.

In the lighting system 600, a first capacitor 650 is connected in series with the first lighting module 530. The first capacitor 650 is connected in parallel to the second lighting module 540. In the illustrated embodiment, the first capacitor 650 has value of approximately 2.7 microfarad (μF).

A second capacitor 652 is connected in series with both the first lighting module 530 and the second lighting module 540 as illustrated. Further, the second capacitor 652 is connected in series with the first capacitor. In fact, the second capacitor 652 connects to the power source 420 on the one side, and on its other side, the second capacitor 652 connects to the first capacitor 650 and to the second lighting module 540. In the illustrated embodiment, the second capacitor 652 has a value of approximately 3.3 μF.

Figure 7:
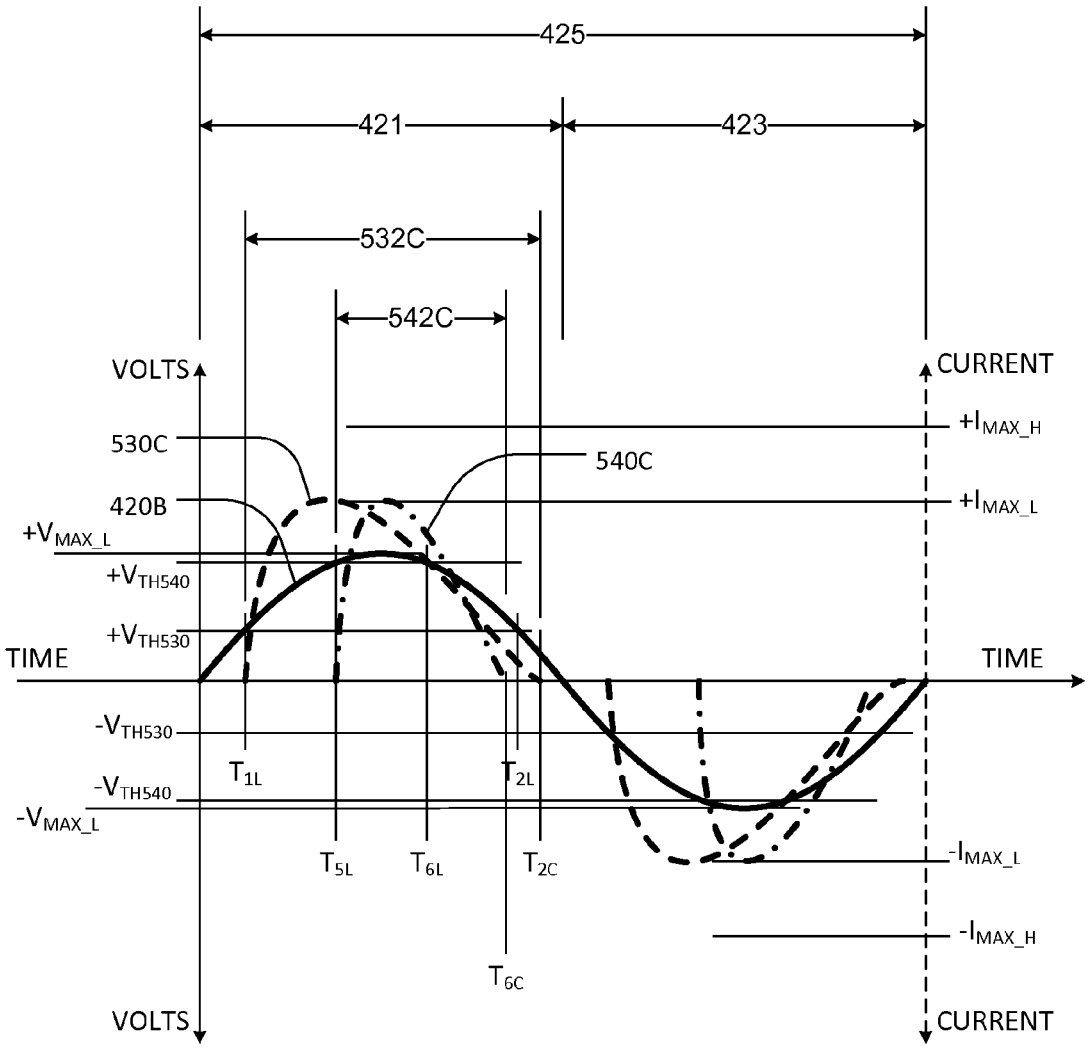
FIGS. 7 and 8 are graphs illustrating various electrical characteristics of the embodiment of FIG. 6.

FIG. 7 is a graph illustrating various electrical characteristics of the embodiment of FIG. 6. As with the graphs of FIGS. 4 and 5, the X-axis represents time flowing from left to right; the first Y-axis (solid line) represents electrical voltage applied to the lighting system 600; and the second Y-axis (dashed line) represents current flowing in the lighting system 600. In FIG. 7, for the input power, the lower voltage 420B curve is used for illustrative purposes.

Referring to FIGS. 6 and 7, when the voltage power 420B is applied to the system 600, during its positive swing cycle 421, the first lighting module 530 conducts current (and generates light) when its activation threshold voltage $V_{TH530}$ is exceeded at time $T_{1L}$. Here, the first lighting module current is represented by dashed curve 530C. The first lighting module 530 continues to conduct current (and generate light) 530C until the voltage applied across the first lighting module 530 fails to exceed its activation threshold voltage $V_{TH530}$. Here, because of the effects of the capacitors 650 and 652, the voltage applied across the first lighting module 530 falls below the activation threshold voltage $V_{TH530}$ at time $T_{2C}$. This is different than the operations of the lighting system 500 (of FIGS. 3 through 5) where the first lighting module current 530B stops at time $T_{2L}$.

In fact, for the lighting system 600, the first lighting module current 530C trails off after reaching its peak until it stops flowing at time $T_{2C}$. Accordingly, the duration 532C of the first lighting module current 530C is greater than the duration 532B (of FIG. 5) of the first lighting module current 530B.

Similarly, when the voltage power 420B is applied to the system 600, during its positive swing cycle 421, the second lighting module 540 conducts current (and generates light) when its activation threshold voltage $V_{TH540}$ is exceeded at time $T_{5L}$. Here, the second lighting module current is represented by dash-dot curve 540C. The second lighting module 540 continues to conduct current (and generate light) 540C until the voltage applied across the second lighting module 540 fails to exceed its activation threshold voltage $V_{TH540}$. Here, because of the effects of the capacitors 650 and 652, the voltage applied across the second lighting module 540 falls below the activation threshold voltage $V_{TH540}$ at time $T_{6C}$. This is different from the operations of the lighting system 500 (of FIGS. 3 through 5) where the second lighting module current 540B stops at time $T_{6L}$.

In fact, for the lighting system 600, the second lighting module current 540C trails off after reaching its peak until it stops flowing at time $T_{6C}$. Accordingly, the duration 542C of the second lighting module current 540C is greater than the duration 542B (of FIG. 5) of the second lighting module current 540B. During the negative swing cycle 423, the lighting system 600 has similar operating characteristics but only in reverse electrical direction. This is indicated by the graph of FIG. 7.

Figure 8:
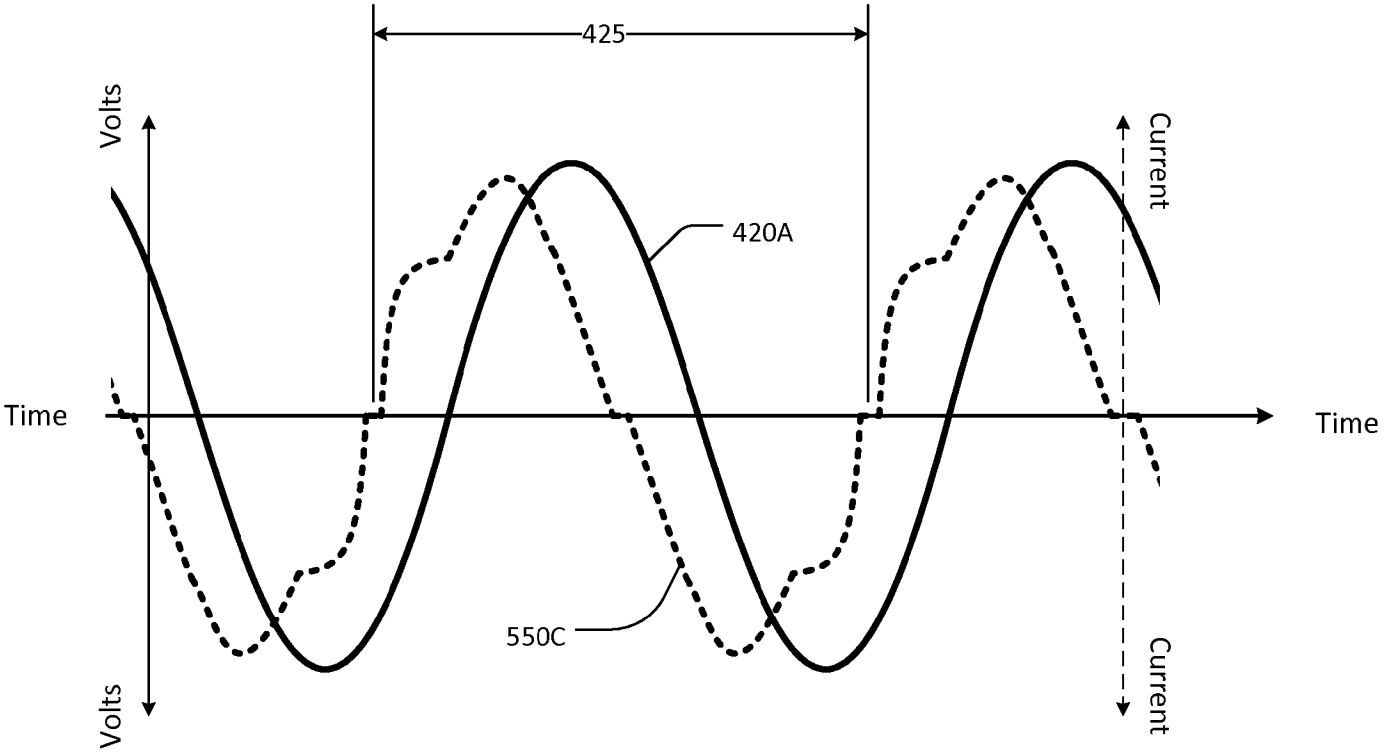

For the purposes of clarity of illustration and discussion, the input AC power (420A and 420B) and the current graphs are illustrated as being in synch with each other. However, due to the capacitors 650 and 652, the current typically leads voltages. This is illustrated in FIG. 8. FIG. 8 illustrates the input power voltage 402B and a combined current curve 550C that is combined value of the two current curves 530C and 540C of FIG. 7. In FIG. 8, multiple cycles of the input power voltage 402 is illustrated to more clearly illustrate the leading nature of the current 550C.

These capacitors 650 and 652 present capacitance and capacitive reactance to the input voltage 420A and 420B. In the present example, the power cycle of the input voltages 420A and 420B is delayed by almost approximately 15.1 ms. As for the beginning and the ending of the cycle period 425, it is arbitrary where the cycle period is deemed to begin and to end as long as the cycle period includes a complete oscillation, the entire 360 degrees.

As is apparent from FIG. 8, the shape of the combined current curve 550C is similar to the shape of the power supply voltage provided by the dimming device 420. That is, the shape of the combined current curve 550C is only slightly distorted compared to the shape of the power supply voltage 420A (same as applied to 420B). Accordingly, the total harmonic distortion (THD) generated by the lighting system 600 of FIG. 6 when connected to the input AC power 420 is comparatively low.

Third Embodiment

Figure 9:
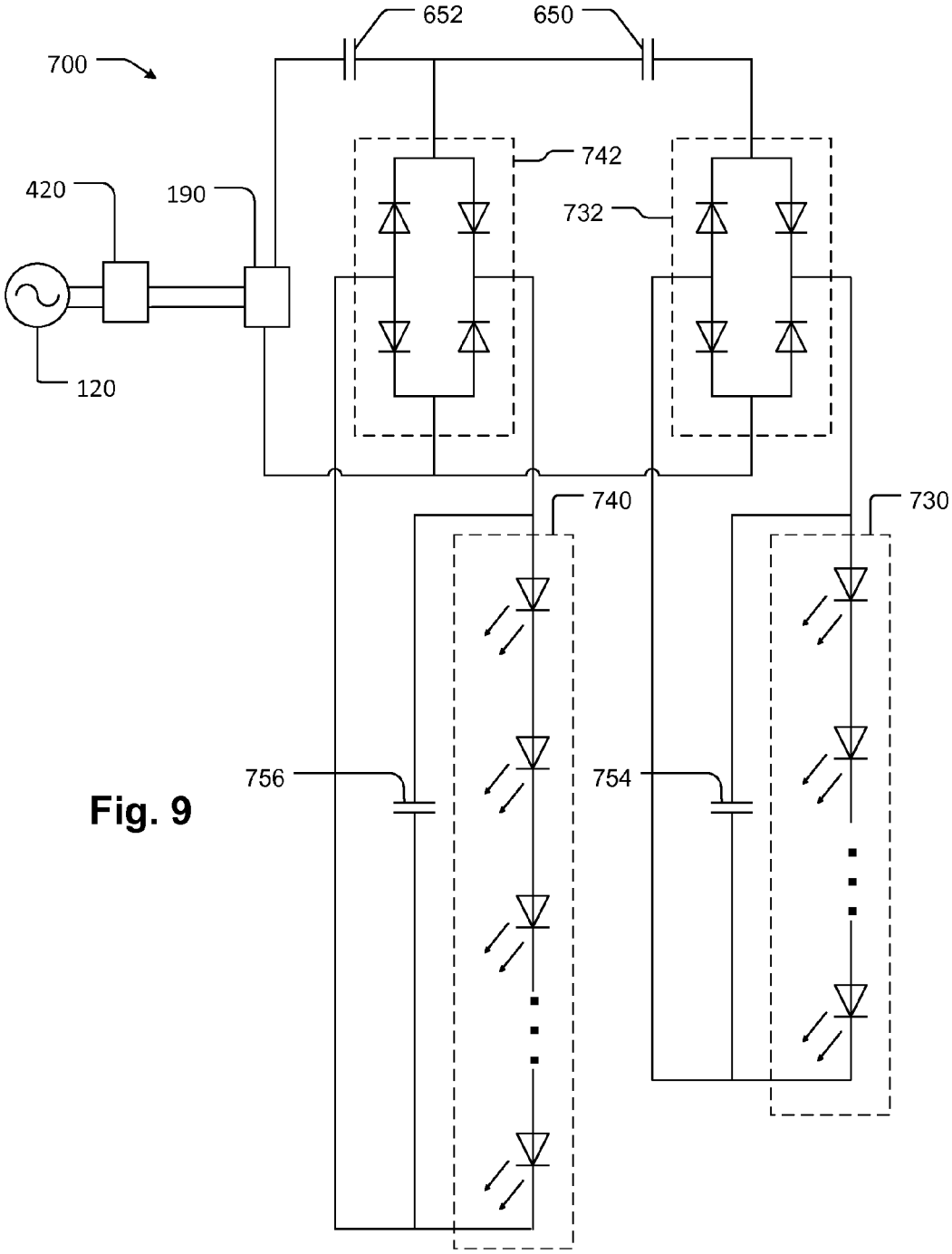
FIG. 9 is a lighting system in accordance with yet another embodiment of the present invention.

FIG. 9 illustrates yet another embodiment of the present invention. Referring to FIG. 9, a lighting system 700 includes a first lighting module 730 including at least one light emitting element. In the illustrated embodiment, the first lighting module 730 includes a plurality of light emitting diodes serially connected in a forward direction. Again, the designation of forward or reverse is arbitrary. A first rectifier 732 is connected to the first lighting module 730. A first capacitor 650 is connected to the first rectifier 732. For the first lighting module 730, each light emitting element can be a light emitting diode (LED) such as, for example LED model LW540A which operate generally between three to four forward volts. LW540A and similar LEDs are available in the marketplace. In the illustrated embodiment, the first lighting module 730 includes 12 serially connected LEDs. The first rectifier 732 can have any known rectifier configuration. In the illustrated embodiment, the first rectifier 732 is a diode-bridge type rectifier having the illustrated configuration, each diode being, for example, a 1N4004 rectifier diode available in the marketplace. The first capacitor 650 can be, for example, a 1.47 μF 100V Polyester type capacitor. The actual model, value, and type of these diode and capacitor components and the number of LEDs in the first lighting module 730 may vary depending on application. The first lighting module 730 has a first activation voltage and generates, upon activation, light having a first color temperature.

In the illustrated embodiment, the second lighting module 740 includes a plurality of light emitting diodes connected in a forward direction. Again, the designation of forward or reverse is arbitrary. A second rectifier 742 is connected to the second lighting module 740. For the second lighting module 740, each light emitting element can be a light emitting diode (LED) such as, for example type LW540A discussed above. In the illustrated embodiment, the second lighting module 740 includes 23 serially connected LEDs. The second rectifier 742 can have any known rectifier configuration. In the illustrated embodiment, the second rectifier 742 is a diode-bridge type rectifier having the same configuration and components as the first rectifier 732. The actual model, value, and type of these diode and capacitor components and the number of LEDs in the second lighting module 740 may vary depending on application. The second lighting module 740 and the second rectifier 742 are connected to the first lighting module 730 and the first rectifier 732 in parallel. Continuing to refer to FIG. 9, a second capacitor 652 is connected in series with both the first rectifier 732 and the second rectifier 742. The second capacitor can be 652, for example, a 3.75 μF 250V Polyester type capacitor. The second lighting module 740 has a second activation voltage and generates, upon activation, light having a second color temperature.

The lighting system 700 may include the supporting circuit 190 illustrated in more detail in FIG. 10 and discussed below. The supporting circuit 190 includes one or more components to protect the lighting system 700, to support the operations of the lighting system 700, or both. For example, the supporting circuit 190 is used to limit in-rush current at turn-on. If the in-rush current is not limited, the in-rush current may charge the capacitors 650 and 652 too rapidly, potentially damaging power switches used to activate the lighting system. Again, the supporting circuit is useful in many implementations but not absolutely necessary for the operations of the lighting system 700.

The operations of the lighting system 700 are mostly similar to the operations of the lighting system 600 of FIG. 6 and discussed above but there are some minor differences. Again, the dimming device 420 provides input AC voltage 420A or 420B as in FIGS. 4, 5, 7, and 8. The input AC power passes through the supporting circuit 190, passes through the capacitors 650 and 652. However, here, prior to reaching the lighting modules, 730 and 740, the input AC power is rectified (converted into direct current (DC) power) by rectifiers 732 and 642 respectively. Actually, the resultant DC power is a pulsed-DC voltage. The pulsed-DC voltage across the first lighting module 730 is smoothed by a third capacitor 754 connected in parallel with the first lighting module 730. The third capacitor 754, for example only, can be a 1.0 μF 200V electrolytic type capacitor. The third capacitor 754 reduces ripples of the pulsed-DC voltage applied to the first lighting module 730. Such ripple reduction may be useful for some types of light emitting elements, for some application, or both.

Similarly, the pulsed-DC voltage across the second lighting module 740 is smoothed by a fourth capacitor 756 connected in parallel with the second lighting module 740. The fourth capacitor 756, for example only, can be a 1.0 μF 200V electrolytic type capacitor. The fourth capacitor 756 reduces ripples of the pulsed-DC voltage applied to the second lighting module 740. Such ripple reduction may be useful for some types of light emitting elements, for some application, or both.

Fourth Embodiment

Figure 10:
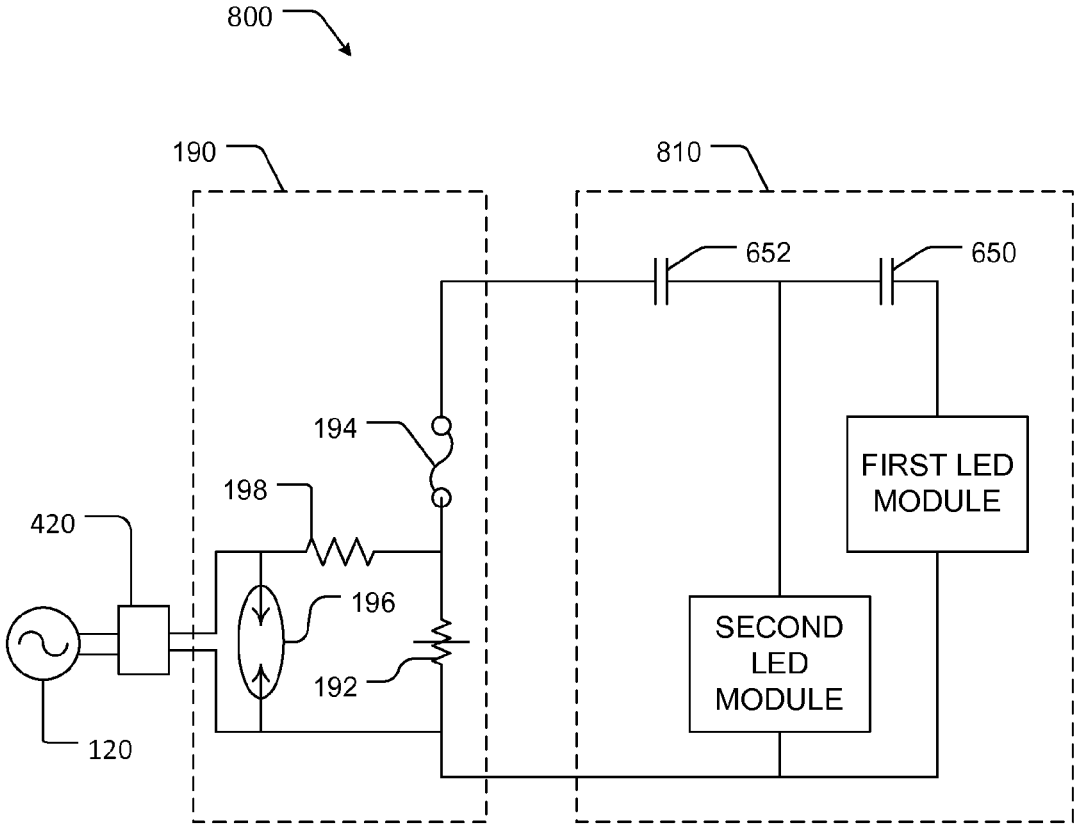
FIG. 10 is a lighting system in accordance with yet another embodiment of the present invention.

FIG. 10 illustrates another embodiment of the present invention. Referring to FIG. 10, a protected lighting system 800 includes the lighting system 810. The lighting system 810 may be configured similarly to the lighting system 500, the lighting system 600, or the lighting system 700 of FIGS. 3, 6, and 9, respectively. The supporting circuit 190 is connected between the dimming device 420 and the lighting system 810. The supporting circuit 190 includes one or more components to protect the lighting system 810, to support the operations of the lighting system 810, or both. For example, the supporting circuit 190 is used to limit in-rush current at turn-on. If the in-rush current is not limited, the in-rush current may charge the capacitors 650 and 652 too rapidly, potentially damaging power switches used to activate the lighting system.

In the illustrated embodiment, a thermistor 198 specifically provides in-rush current limiting when first powering the circuit. In case the mains voltage is at the peak of its waveform when first applied to the circuit, there would be a relatively fast voltage surge across capacitive elements, leading to a large in-rush or surge current that could harm the LEDs or other components. When cold, the thermistor 198 acts as a resistor to minimize surge current. When heated (due to the operation of the protected lighting system 800) the thermistor 198 offers decreased resistance so as minimize the resistive effects against the flow of current through the protected lighting system 800. Additionally, a fuse 194 may briefly experience a large current that could cause it to fail open, were it not for the thermistor 198.

The supporting fuse 194 is connected in series with the lighting system 810. The fuse 194 protects the lighting system 810 by opening the circuit (thereby disconnecting the lighting system 810 from the power source 120) in case of excessive current flows. Rating of the fuse 194 varies depending on the implementation. In the illustrated embodiment, as an example only, the fuse 194 may have a rating in the order of one or two amperes.

Another protective device is a spark gap 196 that protects the lighting system 810 from excessive input voltage. When excessive voltage is applied to the lighting system 810, the current jumps the spark gap 196 rather than being directed to the lighting system 810 thereby protecting the lighting system 810 from the excessive voltage. Rating of the spark gap 196 varies depending on the implementation. In the illustrated embodiment, as an example only, the spark gap 196 may have a rating on the order of one kilo-volts.

In the illustrated embodiment, the supporting circuit 190 includes a transient voltage suppressor 192 such as, for example, a metal oxide variable (MOV) resistor 192 to prevent a voltage spike on lighting system 810 when transient voltage surges appear on the power source 120. The MOV resistor 192 can be, for example, MOV resistor known as part VE13M00151K in the marketplace. The MOV resistor 192 is connected in parallel with the lighting system 810, through the fuse 194.

The supporting circuit 190 need not include all the components illustrated in FIG. 10. For example, the supporting circuit 190 can be as simple as including only the MOV resistor 192 and still be within the scope of the present invention. The supporting circuit 190 may include any one or more of the components illustrated, in any combination. Furthermore, the supporting circuit 190 may include additional components not illustrated therein and still be within the scope of the present invention.

CONCLUDING REMARKS

Note that although the invention has been described in terms of LEDs, the invention and embodiments described herein are not limited to LEDs but may be used with other light emitting devices such as, for example only, Organic Light Emitting Diode (OLED), Light Emitting Polymer (LEP), and Organic Electro Luminescence (OEL), or any other lighting element that generates or causes total harmonic distortion at a level that is higher than desired. The present invention is applicable to and includes regions where the supplied AC power is at 240 volts such as in Europe or other parts of the world. The present invention is applicable to and includes regions where the supplied AC power is at 50 Hz such as in Europe or 400 Hz such as on board an aircraft. The present invention is applicable to and includes use of rectifiers other than the illustrated example rectifiers which are used only for the purposes of disclosing the invention. The lighting system of the present invention can be, for example, a light bulb, a lighting surface, a light wall, a projection system, and the like that includes a plurality of light emitting elements such as LEDs.

What is claimed is:

1. A lighting system comprising:

a first lighting module including at least one light emitting element, the light emitting element of said first lighting module generating, when power is applied, light at a first color temperature;

wherein said first lighting module having a first activation voltage;

a second lighting module including at least one light emitting element, the light emitting element of said second lighting module generating, when power is applied, light at a second color temperature;

wherein said second lighting module having a second activation voltage;

a current limiting element in series with said second lighting module; and whereby the ratio of the amount of current flow to the first module relative to the amount of current flow to the second module varies with the applied power amplitude.

2. The lighting system recited in claim 1 wherein said first lighting module including at least one pair of lighting elements, each pair including a first lighting element connected in a first electrical direction and a second lighting element connected in a second electrical direction, the second electrical direction opposite the first electrical direction.

3. The lighting system recited in claim 2 wherein the lighting elements are light emitting diodes.

4. The lighting system recited in claim 1 wherein said second lighting module is electrically connected in parallel to said first lighting module.

5. The lighting system recited in claim 1 further comprising:

an input for power;

a first capacitor connected in series between said input for power and said first lighting module;

a second capacitor connected in series between said second lighting module and the connection of said first capacitor to said first lighting module;

wherein, when electrical power is applied to the lighting system, said first lighting module conducts electrical current during a first conduction period within each power cycle and said second lighting module conducts electrical current during a second conduction period within each power cycle.

6. The lighting system recited in claim 5 wherein the second conduction period occurs within the first conduction period.

7. The lighting system recited in claim 5 wherein a portion of the first conduction period overlaps a portion of the second conduction period.

8. A lighting system comprising:

an input for power;

a first lighting module including at least one light emitting element, the light emitting element of said first lighting module generating, when power is applied, light at a first color temperature;

a second lighting module including at least one light emitting element, the light emitting element of said second lighting module generating, when power is applied, light at a second color temperature; and a first rectifier connected to said first lighting module;

a second rectifier connected to said second lighting module;

a first capacitor connected in series between said input for power and said first rectifier;

a second capacitor connected in series between said first rectifier and said second rectifier;

a third capacitor connected in parallel to said first lighting module;

a fourth capacitor connected in parallel to said second lighting module;

wherein said first lighting module comprises a plurality of light emitting elements connected in series, having a first activation voltage; and wherein said second lighting module comprises a plurality of light emitting elements connected in series, having a second activation voltage.

9. The lighting system recited in claim 1 further comprising supporting circuit, said supporting circuit comprising at least one protective element from a group consisting of a thermistor that presents resistance when cold to suppress in-rush current and when heated decreases resistance to lighting system current flow, a spark gap, and a transient voltage suppressor.

10. The lighting system recited in claim 1 wherein said first lighting module includes a first predetermined number of LEDs and said second lighting module includes a second predetermined number of LEDs wherein the first predetermined number is less than the second predetermined number.

11. A method of generating light, the method comprising:

applying electrical energy having an amplitude;

activating a first lighting module at a first activation voltage;

activating a second lighting module at a second activation voltage;

wherein the first lighting module including at least one light emitting element, the light emitting element of the first lighting module, when activated, generating light at a first range of color temperature;

wherein the second lighting module including at least one light emitting element, the light emitting element of the second lighting module, when activated, generating light at a second range of color temperature; and varying the ratio of current flow amount to the first module relative to current flow amount to the second module, as a function of the amplitude of applied electrical energy.

12. The method recited in claim 11 wherein said first lighting module includes at least one pair of lighting elements, each pair including a first lighting element connected in a first electrical direction and a second lighting element connected in a second electrical direction, the second electrical direction opposite the first electrical direction.

13. The method recited in claim 12 wherein the lighting elements are light emitting diodes.

14. The method recited in claim 11 with a current path to the first lighting module through a first capacitor; and said second lighting module is electrically connected in parallel to said first lighting module through a second capacitor, the current path to the second lighting module extending through both first and second capacitors.

15. The method recited in claim 11 wherein the first lighting module conducts electrical current during a first conduction period within each power cycle and the second lighting module conducts electrical current during a second conduction period within each power cycle.

16. The method recited in claim 15 wherein the second conduction period occurs within the first conduction period.

17. The method recited in claim 15 wherein a portion of the first conduction period overlaps a portion of the second conduction period.

18. A lighting system adapted to connect to an electrical power source providing alternating current (AC) electrical power, the electrical power having power cycles and adapted to provide variable level of voltage, the lighting system comprising:

a first current path including at least one light emitting element, the light emitting element of said first current path generating, when power is applied, light at a first color temperature;

wherein said first current path has a first activation voltage;

a second current path including at least one light emitting element, the light emitting element of said second current path generating, when power is applied, light at a second color temperature;

wherein said second current path has a second activation voltage; and a current limiting element in series with the second current path so that the ratio of the amount of current flow to the first module relative to the amount of current flow to the second module varies with the amplitude of applied power.

* * * * *